US006588606B2

(12) United States Patent
Miller, Jr. et al.

(10) Patent No.: US 6,588,606 B2
(45) Date of Patent: Jul. 8, 2003

(54) PRODUCT MERCHANDISING ASSEMBLY

(75) Inventors: Donald J. Miller, Jr., Belleville, IL (US); Maynard Johnson, Ballwin, MO (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 09/953,598

(22) Filed: Sep. 17, 2001

(65) Prior Publication Data

US 2002/0148795 A1 Oct. 17, 2002

Related U.S. Application Data

(63) Continuation-in-part of application No. 29/140,214, filed on Apr. 13, 2001, now Pat. No. Des. 463,188.

(51) Int. Cl.[7] ..... A47F 5/08
(52) U.S. Cl. ..... 211/88.01
(58) Field of Search ..... 211/88.01, 75, 211/106, 59.2, 85.4, 90.03, 85.31, 126.9, 181.1

(56) References Cited

U.S. PATENT DOCUMENTS 4,416,380 A 11/1983 Flum
4,984,693 A 1/1991 Belokin, Jr. et al.
5,330,261 A * 7/1994 Bennett ..... 211/88.01
5,351,841 A 10/1994 Belokin et al.
5,358,128 A 10/1994 Belokin et al.
5,381,990 A 1/1995 Belokin et al.
5,547,088 A 8/1996 Belokin et al.
5,913,433 A * 6/1999 Belokin et al. ..... 211/75
6,089,387 A * 7/2000 Varfolomeeva ..... 211/106
6,386,379 B1 * 5/2002 Battaglia ..... 211/106

OTHER PUBLICATIONS

Martin Paul, Inc., *Hi–Vis for Glass Cooler Doors & Windows*, Denton, Texas, U.S.A.

* cited by examiner

*Primary Examiner*—Alvin Chin-Shue
*Assistant Examiner*—Sarah Purol
(74) *Attorney, Agent, or Firm*—Blackwell Sanders Peper Martin LLP

(57) ABSTRACT

A product merchandising assembly for attachment to a substantially vertical transparent surface such as the interior surface of a refrigerated cooler door including a removably attachable product storage member for receiving and retaining a plurality of product containers therewithin, a removably attachable graphic panel, and a plurality of suction type attachment devices for enabling the product storage member and the graphic panel to be simultaneously removably attached to the vertical transparent surface, the graphic panel being positioned and located between the product storage member and the vertical transparent surface so as to be viewed therethrough.

25 Claims, 4 Drawing Sheets

PRODUCT MERCHANDISING ASSEMBLY

CROSS REFERENCE TO RELATED APPLICATION

This application is a continuation-in-part of design patent application Ser. No. 29/140,214, filed Apr. 13, 2001, now Pat. No. D 463,188.

BACKGROUND OF INVENTION

The present invention relates generally to product merchandising display units and, more particularly, to a product display unit for storing and displaying products on the interior surface of a transparent cooler or freezer door, the present unit being designed to accommodate an advertising sign or placard positioned so as to be visible through the cooler or freezer door.

It is common practice to store and display shelved products, such as chilled soft-drink products, in a refrigerated display cooler in such a manner so as to attract the attention of the consumer. Product storage and display coolers typically have an openable transparent door through which a wide variety of different types of shelved products may be viewed. These products are typically stored on a plurality of vertically spaced conventional shelves located within the interior of the cooler. As a result, there exists within the cooler an unused space between the inside surface of the cooler door and the leading edge portion of the shelving located therein. It is known in the art to capitalize on this unused space by affixing a detachable product display unit to the interior surface of the cooler door. These known detachable product display units are typically bulky; they obscure many of the products stored on the conventional shelving associated with the particular display cooler; they do not adequately advertise the products displayed therein; and they suffer from still other disadvantages as hereinafter further explained.

For purposes of sales and marketing, it is imperative that a customer be able to adequately see all products stored and displayed within a display cooler. For this reason, cooler doors are typically made of a transparent material such as glass. Detachable product display units that attach to the inside surface of a cooler door have proven to be beneficial in terms of utilizing the available space between the cooler door and the associated conventional cooler shelving, however, they also tend to obscure the products contained within the remainder of the cooler. This obscuration will have a negative impact on sales as a consumer is less likely to purchase what cannot readily be seen. Further, the construction of the known detachable product display units which are attachable to the inside surface of a cooler door are such that it is often difficult to see the products that are stored and contained within the detachable display unit. Recent years have witnessed a growing awareness of the value of point-of-purchase fixtures and other display devices which capitalize on identification and promotion of products at the point of sale. Using a device that obscures the product being sold can be disastrous to a merchant and is counterproductive given the merchant's goal of displaying a product and promoting the sale thereof. Even if the product contained within the detachable product display unit is visible, the customer typically views the back of the detachable product display unit through the cooler doors and therefore the back of the products stored therein, a feature which is less than desirable from both a marketing and an aesthetic standpoint. There is, therefore, a need for a device which allows one to make use of the unused space between the inside surface of the cooler door and the conventional shelving associated therewith while allowing visibility of the products displayed on the conventional shelving and while providing a means for displaying product advertising or other material in such a manner so as to attractively identify and promote the sale of products contained therewithin.

It is also important that a product stored within a detachable product display unit be quickly and easily removed therefrom. If a customer cannot quickly and easily remove the product, the cooler door will then be held open for a longer period of time thereby increasing the overall operating costs to the merchant. Though the increased opening time may only be seconds for each individual customer, the cumulative effect of such door openings hour after hour during a typical work week can drastically increase the operating costs of the cooler. Such activity may also decrease the life expectancy of the cooler's refrigeration system. Thus, there is a need for a detachable product display unit that allows customers to remove product quickly and easily with minimal loss of cool air from the interior of the cooler.

SUMMARY OF INVENTION

The present product merchandising assembly overcomes the disadvantages and shortcomings of known product merchandising devices and teaches the construction and operation of a product merchandising unit removably attachable to the inside surface of a cooler door which both allows improved visibility of products positioned on conventional shelving within the cooler and, importantly, provides a means for attractively identifying and promoting the products displayed therein by taking advantage of the transparent nature of cooler doors.

The present assembly can be used for chilled, unchilled, or frozen products, and is adaptable for attachment to the inside surface of a door or other vertical surface associated with any cooler, freezer, or cabinet used to store or display products. The present device is particularly well-suited for merchandising and displaying energy-type drinks, such as those typically distributed in 250 ml aluminum cans, but can be sized and shaped to display a wide variety of other products such as soft drinks, fruit juices, dairy products and the like in supermarkets, convenience stores, grocery outlets, fast food outlets, and a wide variety of other wholesale and retail stores. It is also anticipated that the present assembly can also be utilized in a wide variety of other product merchandising and storing applications.

Each of the several embodiments of the present invention disclosed herein comprises a product storage member which can be detachably connected to a flat surface such as the interior surface of a cooler door. The product storage member is sized and shaped to receive and retain products therein and is adapted to receive a graphic panel which, in one embodiment, faces the transparent interior portion of the cooler door and thus is visible to customers through the door. The product storage member includes a plurality of spaced upright members fixedly attached to a plurality of front and rear transverse members and a plurality of spaced longitudinal members arranged in groups to form a plurality of tracks for holding products thereon. The tracks are preferably vertically arranged one above the other and the graphic panel is sized and shaped to be held against one side of the product storage member and against the inside surface of the cooler door. The products are also positioned and stackably arranged within the present product storage member in a manner to facilitate quick and easy removal therefrom when the cooler door is opened. The combination of the product storage member and the graphic panel forms the present product merchandising assembly.

The present graphic panel is an important tool in a merchant's advertising and promotional activities with respect to a particular product because the graphic panel will depict images and text designed to specifically identify and sell the products contained within the product storage member. This provides an excellent means by which product manufacturers and retailers may attract the attention of potential customers at or near the point of sale. It is also contemplated that the graphic panel can be used to impart any information that the merchant wishes to impart to his customers, such as information concerning promotional contests and the like. Any plurality of graphic panels can be utilized with the same product storage member, each graphic panel promoting a different product or imparting different information to the consumer depending upon the particular marketing situation. At the same time that the graphic panel imparts useful advertising or other information to the consumer, the graphic panel also serves an aesthetic purpose. The side of the present product storage member which would be otherwise visible to consumers through the transparent cooler doors is now shielded and no longer visible to the customer. Instead, the unappealing view of the side portion of the present unit is replaced with the images and/or text associated with the graphic panel. In the event that a merchant has no information that he wishes to impart to a customer, the graphic panel could depict an image that is aesthetically pleasing. Thus, the present product merchandising assembly enhances the marketability of the products positioned therein and it improves the general image of the display area.

The present assembly also minimizes the amount of time the customer needs to open a cooler door in order to retrieve a product thereby lessening the amount of cool air that escapes from the interior of the cooler. This is accomplished in two ways. First, the present graphic panel serves to identify the products contained within the product storage member prior to opening of the cooler door. This means that a customer will not have to open the cooler door in order to identify the product and is not likely to hold the door open while contemplating a purchase. Second, the orientation of the preferred embodiment, installed vertically inside the cooler door, is such that the customer does not have to fully open the cooler door in order to reach inside and remove the product. Product removal is quick and provides minimal opportunity for keeping the cooler door open for extended periods of time thereby minimizing the amount of cool air that can escape from the interior of the cooler. This reduces operating costs.

These and other features and advantages of the present invention will become apparent to those skilled in the art after considering the following detailed specification in conjunction with the accompanying drawings.

DETAILED DESCRIPTION

Figure 1:
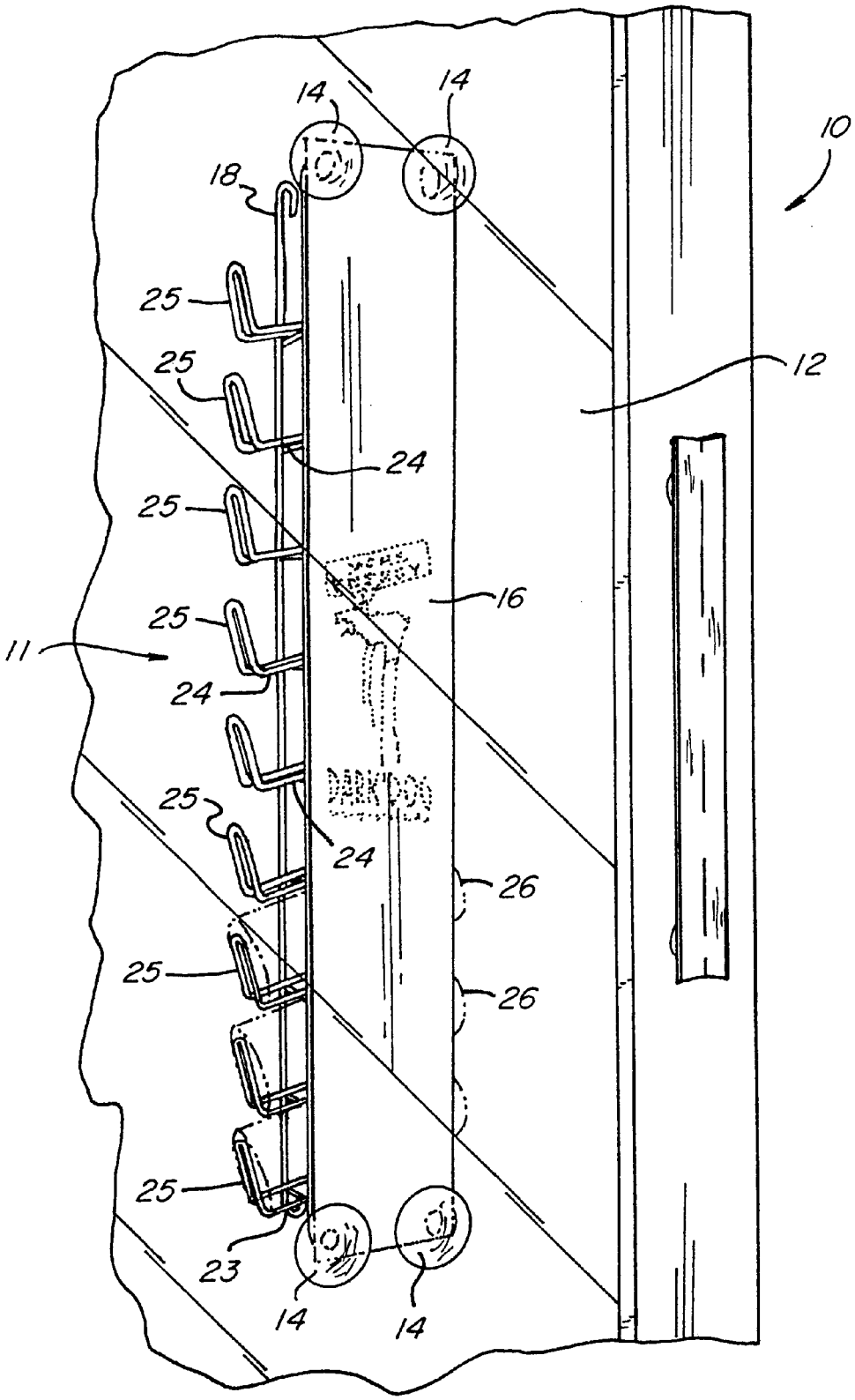
FIG. 1 is a perspective view of a preferred embodiment of the present product merchandising assembly illustrating attachment of the present assembly to the inside surface of a transparent cooler door, the graphic panel being positioned so as to be visible through the cooler door.

Referring to the drawings more particularly by reference numbers wherein like numerals refer to like parts, number 10 in FIG. 1 identifies one embodiment of a product merchandising assembly 10 constructed according to the teachings of the present invention. The embodiment 10 is specifically designed for use inside a refrigerated display unit or cooler and includes a product storage member 11, a graphic panel 16, and a plurality of suction type attachment devices 14. The assembly 10 is ideally suited for use in supermarkets and convenience stores for storage and display of refrigerated beverages, such as bottled and canned soft drinks, among other products. The embodiment 10 illustrated in FIG. 1 is particularly well suited for storing and displaying 250 ml beverages commonly known as energy drinks.

Figure 3:
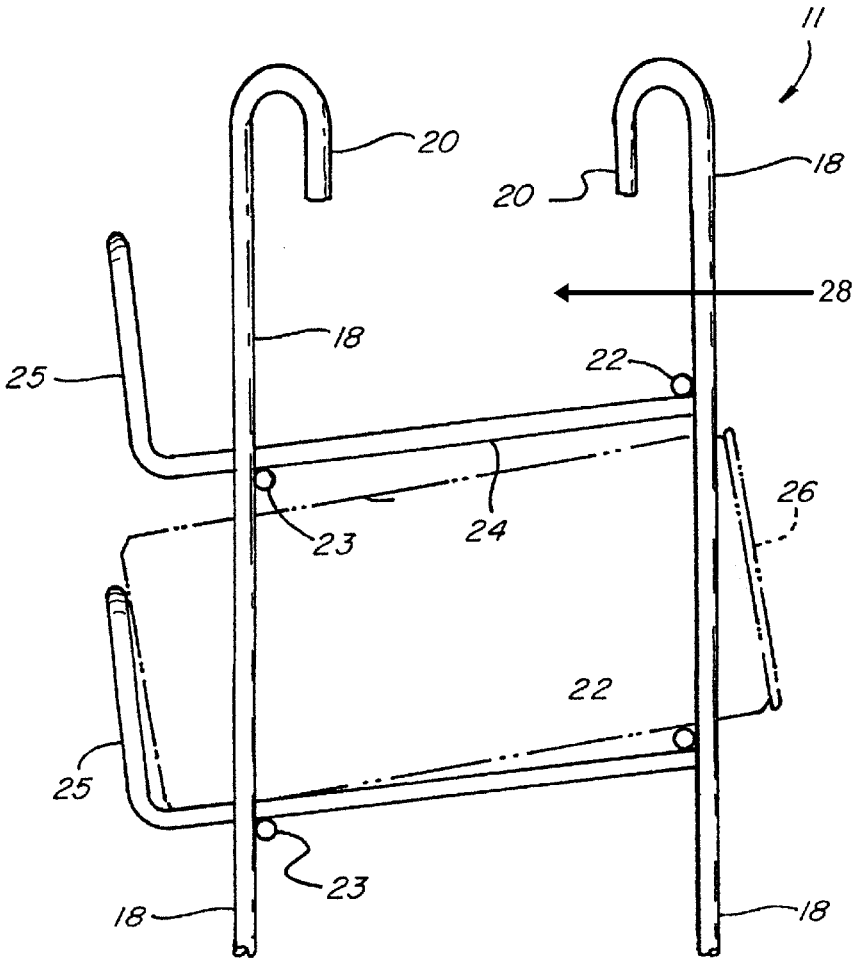
FIG. 3 is a partial side view of the topmost portion of the product storage member illustrated in FIG. 1.
Figure 4:
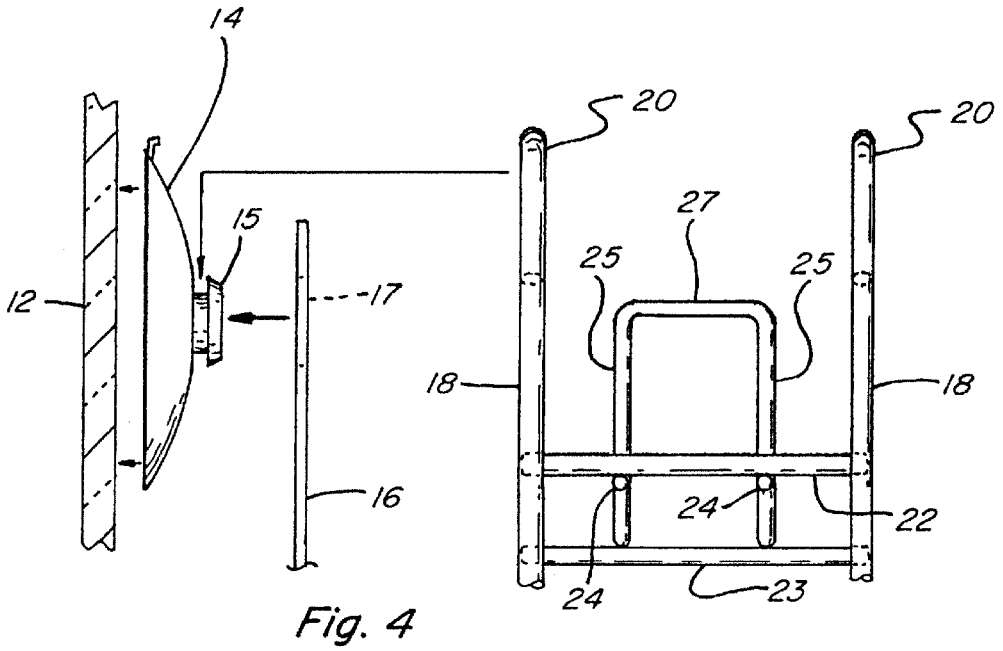
FIG. 4 is an exploded end view of the assembly illustrated in FIG. 1 showing the connectivity of the various components of the assembly.

As shown in FIG. 1, the present assembly 10 includes a product storage member 11 adapted to attach to a surface 12, such as the interior surface of a refrigerated cooler door. In this application, surface 12 will generally be made of glass or some other transparent material. Product storage member 11 may be made from metal, plastic, or any other material suitable to receive and retain a product and may be adapted to directly attach to the surface 12, or it may be attached as illustrated in FIG. 1 by some attachment means such as via a plurality of suction type attachment devices 14. A graphic panel 16 is removably attached to the surface 12 and held in position adjacent to one side portion of the product storage member 11 such that the panel 16 is oriented so as to be visible through surface 12. In this regard, the panel 16 includes a plurality of strategically positioned openings 17 each sized and shaped to receive at least a portion 15 of a suction type device 14 as best illustrated in FIGS. 3 and 4. Graphic panel 16 may be made of plastic, cardboard, or any other material with a surface suitable for displaying text and images thereon. The suction type attachment devices 14 hold both the product storage member 11 and the graphic panel 16 in proper position relative to each other and in attachment to the surface 12.

Figure 2:
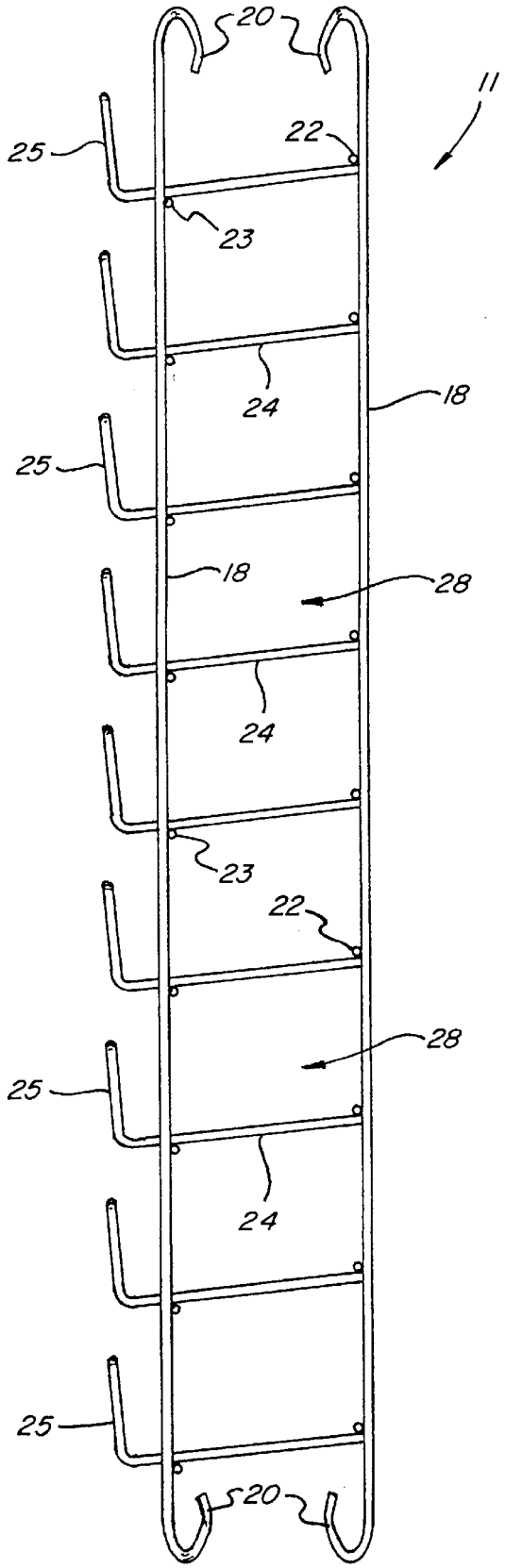
FIG. 2 is a side elevational view of the product storage member illustrated in FIG. 1.
Figure 5:
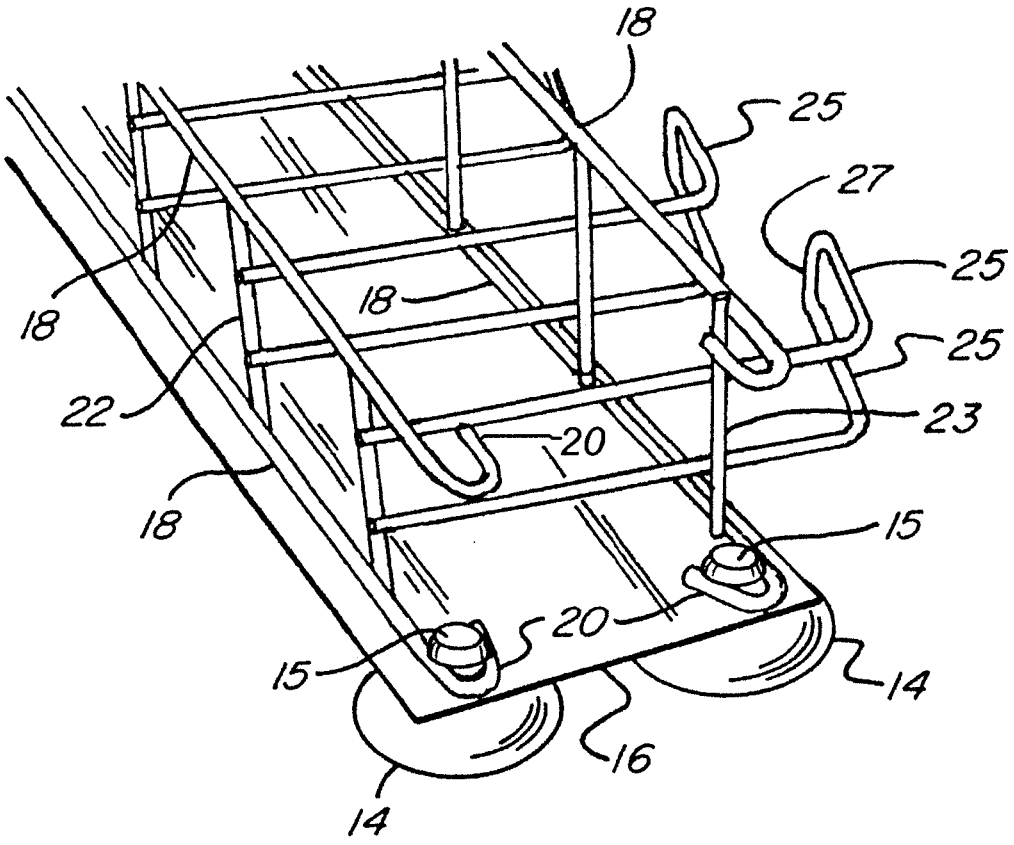
FIG. 5 is a partial perspective view of the assembly illustrated in FIG. 1 rotated to a somewhat horizontal position depicting the construction of one end portion of the product storage member and attachment of the graphic panel thereto.

As best shown in FIGS. 2, 3 and 5, product storage member 11 is preferably a wire structure formed of four upright members 18 (only two of which are visible in FIG. 2), and a plurality of front and rear transverse members 22 and 23. Each end of each upright member 18 is provided with a hooked portion 20. Front transverse members 22 are slightly elevated with respect to rear transverse members 23. A plurality of product storage compartments are defined by a plurality of spaced longitudinal members 24 which form parallel adjacent tracks spaced along the vertical length of product storage member 11. Each pair of longitudinal members 24 form a track associated with one of the product storage compartments 28, each pair of longitudinal members 24 being fixedly attached to the underside of a front transverse member 22 and to the topside of a rear transverse member 23 thereby forming an angularly inclined track as best shown in FIG. 2. Each of the longitudinal members 24 also has an angularly disposed upwardly extending portion 25 which serves as a back stop for a product container such as the container 26 positioned within a particular storage compartment. Each pair of upwardly extending portions 25 of longitudinal members 24 may include a transverse portion 27 extending therebetween as best shown in FIG. 4. It is preferred that member portions 25 and 27 be integrally formed with longitudinal members 24, although any conventional means for connecting said members such as welds, solders, and other means of joinder could be utilized.

FIG. 4 is a partial exploded view of one corner portion of the present assembly 10 illustrating the connectivity of the various components of the present invention. Product storage member 11 is shown as viewed from the front of the storage member 11, or from the left side of the assembly 10 illustrated in FIG. 1. The suction devices 14 each include a projecting portion 15 which fits through an opening 17 in graphic panel 16 and further extends through the hooked portion 20 of one of the upright members 18 as best shown in FIGS. 4 and 5. Though only one suction device 14 is illustrated in FIG. 4, four such attachment devices are associated with the present assembly 10, one attaching to each hooked portion 20 of the upright members 18 that are positioned adjacent to surface 12 as illustrated in FIGS. 1 and 5. Suction devices 14 then attach to surface 12 and hold product storage member 11 and panel 16 in proper operative position as illustrated in FIG. 1.

Upright members 18 in conjunction with each set of front and rear transverse members 22 and 23 and corresponding members 24, 25 and 27 form a plurality of receiving areas or storage compartments 28 as described with respect to FIGS. 2 and 3, each receiving area 28 being adaptable to receive and retain a product container 26.

In a preferred embodiment, once assembled, the present assembly 10 is attached to the inside transparent surface of a cooler door such that the front portion of each of the plurality of receiving areas 28 are positioned facing towards that portion of the cooler door which opens for access therewithin. As best shown in FIG. 1, the present assembly 10 is positioned and attached such that a side portion of the overall assembly lies adjacent the transparent surface 12 and the individual product containers 26 positioned therewithin are likewise positioned and located in a sideways orientation as again best illustrated in FIG. 1. Because the present assembly 10 positions the product container 26 in a sideways manner as illustrated in FIGS. 1 and 3 relative to a closed cooler door, the cooler door need only be opened partially in order to easily access and remove a product container 26 from the overall assembly 10. Since the graphic panel 16 will identify and advertise the products positioned within the assembly 10 prior to a customer opening the cooler door, this feature in combination with the orientation of the product containers 26 within the assembly 10 greatly facilitate quick access and removal of the products from the present device and will reduce both the time that the cooler door will remain open in order to access and remove a particular product container 26 from the assembly 10 as well as how far the cooler door need be open in order to accomplish this task. This will ultimately reduce cost and energy associated with operating a particular display cooler, freezer or other cabinet type cooling unit. Also, importantly, since the present assembly 10 orients the individual product containers 26 in a vertical fashion, products stored and merchandised on all of the conventional shelving associated with a particular cooler unit can still be adequately viewed even when the assembly 10 is operatively positioned on the inside surface of a particular cooler door.

In an alternative embodiment, it is recognized and anticipated that the present assembly 10 can be positioned and placed on a wall or other substantially vertical surface, other than the inside portion of a cooler door. In this particular application, the graphic panel 16 will not be located between the product storage member 11 and the vertical wall surface, but instead, the graphic panel 16 will be attached by any suitable attachment mechanism to the side portion of the product storage member 11 facing the consumer while the opposite side portion of the product storage member 11 is attached to the wall surface by suitable attachment means. In this particular application, the product storage member 11 will be positioned and located between the wall surface and the graphic panel 16. Other applications are likewise recognized and anticipated.

As is evident from the foregoing description, certain aspects of the present invention are not limited by the particular details of the examples illustrated herein and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A product merchandising assembly for attachment to a substantially vertical transparent surface comprising:

a removably attachable product storage member having a plurality of vertically spaced product receiving areas for receiving and retaining at least one product in each area in a generally sideways orientation;

a removably attachable graphic panel; and a plurality of suction type attachment devices for enabling said product storage member and said graphic panel to be simultaneously removably attached to the vertical transparent surface, said graphic panel being positioned and located between said product storage member and the vertical transparent surface so as to be viewed therethrough.

2. The product merchandising assembly of claim 1 wherein each of said product receiving areas includes a product storage compartment.

3. The product merchandising assembly of claim 1 wherein said product storage member includes front, rear and opposed side portions, said product storage member being removably attachable to the vertical transparent surface such that one side portion thereof is positioned facing the vertical transparent surface.

4. The product merchandising assembly of claim 1 wherein the vertical transparent surface includes a transparent door panel associated with a refrigerated display unit.

5. The product merchandising assembly of claim 4 wherein the refrigerated display unit includes a plurality of shelves spaced from the transparent door panel defining an unused space therebetween, said product merchandising assembly being removably attachable to the inside surface of the transparent door panel in the unused space.

6. A product merchandising assembly for attaching to a substantially vertical transparent surface comprising:

a product storage member for vertically stackably receiving a plurality of product containers therewithin, said product storage member including a plurality of spaced upright members having opposed end portions, a plurality of front and rear transverse members attached to said spaced upright members, and a plurality of spaced longitudinal members attached to said front and rear transverse members to form a plurality of tracks extending therebetween;

a graphic panel positionable between said product storage member and the substantially vertical transparent surface to which it is attached; and a plurality of suction type devices for simultaneously removably attaching said product storage member and said graphic panel to the substantially vertical transparent surface.

7. The product merchandising assembly of claim 6 wherein each of said upright members includes a hook portion at each opposed end portion thereof, each of said hook portions being engagable with at least a portion of said suction type devices.

8. The product merchandising assembly of claim 6 wherein each of said plurality of spaced longitudinal members are fixedly attached to a bottom surface of one of said front transverse members and to a top surface of one of said rear transverse members.

9. The product merchandising assembly of claim 6 wherein each of said longitudinal members includes an angularly disposed upwardly extending portion.

10. The product merchandising assembly of claim 9 wherein each track is formed by at least a pair of said spaced longitudinal members, and wherein the angularly disposed upwardly extending portions associated with said longitudinal members forming a particular track serve as a stop member at one end portion of said track for a product container positioned on said track.

11. The product merchandising assembly of claim 10 including a transverse member extending between each of the angularly disposed upwardly extending portions associated with the longitudinal members forming each respective track.

12. The product merchandising assembly of claim 6 wherein the space defined by and between a portion of each of said plurality of spaced upright members, a pair of respective front and rear transverse members, and said spaced longitudinal members forming one of said tracks extending between said front and rear transverse members form a product storage compartment for receiving and holding at least one product container therewithin.

13. The product merchandising assembly of claim 6 wherein said graphic panel includes a plurality of openings extending therethrough, each of said openings being sized and shaped to receive at least a portion of one of said suction type devices for removably attaching said graphic panel to the substantially vertical transparent surface.

14. The product merchandising assembly of claim 6 wherein each of said plurality of tracks is angularly disposed relative to a horizontal surface.

15. A product merchandising assembly removably attachable to the interior surface of a cooler door in the unused space located between the cooler door and the associated shelving located therewithin, said product merchandising assembly comprising:

a product storage member for vertically stackably arranging a plurality of product containers therewithin, said product storage member including a plurality of spaced upright members having hook portions associated with each opposite end thereof, a plurality of front and rear transverse members attached in spaced apart relationship to said upright members, and a plurality of spaced longitudinal members attached to said front and rear transverse members to form a plurality of tracks extending respectively therebetween, each of said tracks being formed by a pair of said longitudinal members and each of said pair of longitudinal members having an angularly disposed portion associated therewith at one end portion thereof forming a back stop for a product container positioned on said track;

a plurality of suction type devices each having at least a portion thereof sized and shaped to engage any one of the hook portions associated with said plurality of upright members, said plurality of suction type devices when engaged with at least some of said hook portions removably attaching said product storage member to the interior surface of the cooler door; and a graphic panel positionable between said product storage member and the interior surface of the cooler door, said graphic panel including a plurality of openings extending therethrough positioned and located so as to lie substantially in registration with at least some of the hook portions associated with said upright members when said graphic panel is positioned adjacent said product storage member, each of said openings being dimensioned to receive at least a portion of one of said suction type devices for removably attaching said graphic panel to the interior surface of the cooler door.

16. The product merchandising assembly of claim 15 wherein said product storage member includes front, rear and opposed side portions, said product storage member being removably attachable to the interior surface of the cooler door such that one side portion thereof is positioned facing the interior surface of the cooler door.

17. The product merchandising assembly of claim 16 wherein each of said tracks and at least a portion of each of said upright members define a plurality of vertically spaced product storage compartments, each product storage compartment being adaptable to a hold at least one product container, said product containers being positioned and oriented within said product storage member in a sideways orientation when said product storage member is removably attached to the interior surface of the cooler door such that access to each product storage compartment is closest to that portion of the cooler door which opens for access to the interior of the cooler.

18. The product merchandising assembly of claim 15 wherein each of said plurality of tracks are inclined relative to the horizontal.

19. A product merchandising assembly for attachment to a substantially vertical surface comprising:

a product storage member having a plurality of vertically spaced product storage compartments for receiving and holding a plurality of product containers therewithin in a generally sideways orientation, said product storage member having front, rear and opposed side portions;

a plurality of attachment devices engagable with portions of said product storage member for enabling one side portion of said product storage member to be removably attached to the vertical surface; and a graphic panel removably attachable to the opposite side portion of said product storage member, said graphic panel being shaped and dimensioned so as to substantially cover the opposed side portion of said product storage member when said graphic panel is attached thereto.

20. The product merchandising assembly of claim 19 wherein said product storage member includes a plurality of spaced upright members, a plurality of front and rear transverse members attached to said spaced upright members, and a plurality of spaced longitudinal members attached to said front and rear transverse members to form a plurality of tracks extending therebetween for holding product containers positioned thereon.

21. The product merchandising assembly of claim 20 wherein said plurality of tracks are vertically spaced so as to form a plurality of vertically spaced product storage compartments adaptable for receiving and holding at least one product container positioned therewithin.

22. The product merchandising assembly of claim 2 wherein the product storage member is a wire structure.

23. The product merchandising assembly of claim 1 wherein the product receiving areas have opposite front and back ends with a stop at the back end and the front end being open.

24. The product merchandising assembly of claim 23 wherein the product receiving areas each have a bottom for supporting a product with a bottom being inclined downwardly from the front end toward the back end.

25. The product merchandising assembly of claim 1 wherein said product storage member includes portions adaptable for engaging at least a portion of each of said suction type attachment devices for removably attaching said product storage member to the vertical transparent surface, said graphic panel including a plurality of openings extending therethrough, each of said openings being dimensioned to receive at least a portion of one of said suction type attachment devices for removably attaching said graphic panel to the vertical transparent surface.

* * * * *